United States Patent [19]

Jütte et al.

[11] 4,043,137

[45] Aug. 23, 1977

[54] APPARATUS FOR AND A METHOD OF CONSTRUCTING A TUNNEL

[75] Inventors: Hans Jütte, Dortmund-Brechten; Siegmund H.F.L.M. Babendererde, Bad Vilbel; Adolf Foik, Munich; Reinhard E. J. Bokemeyer, Offenbach, all of Germany

[73] Assignees: Gewerkschaft Eisenhutte Westfalia; Hochtief AG, Frankfurt, both of Germany

[21] Appl. No.: 592,701

[22] Filed: July 2, 1975

[30] Foreign Application Priority Data

Germany ..... 2431652

[51] Int. Cl.[2] ..... E01G 3/02

[52] U.S. Cl. ..... 61/85; 61/45 D; 299/31

[58] Field of Search ..... 61/85, 84, 45; 299/31

[56] References Cited

U.S. PATENT DOCUMENTS

| | | | |
|---|---|---|---|
| 3,381,479 | 5/1968 | Curzio | 61/45 |
| 3,404,920 | 10/1968 | Tabor | 61/85 X |
| 3,650,116 | 3/1972 | Cunningham | 61/85 |
| 3,870,368 | 3/1975 | Winberg et al. | 61/85 X |
| 3,950,956 | 4/1976 | Lobbe | 61/85 |

*Primary Examiner*—Jacob Shapiro
*Attorney, Agent, or Firm*—Sughrue, Rothwell, Mion, Zinn and Macpeak

[57] ABSTRACT

Apparatus for constructing an underground tunnel employs a drive shield composed of elongate drifting cutters disposed side-by-side in a circular configuration around a support frame. Hydraulic rams serve to advance the cutters and to shift up the frame when all the cutters have been advanced. The cutters have rear end portions which engage on a follow-up ring behind the drive shield.

A platform is supported by the frame within the shield and carries some form of working appliance for detaching and removing the debris material. The platform also carries a rotatable concrete spraying device which serves to seal and secure the tunnel wall exposed when the follow-up ring is shifted up to the shield.

14 Claims, 2 Drawing Figures

APPARATUS FOR AND A METHOD OF CONSTRUCTING A TUNNEL

BACKGROUND TO THE INVENTION

The present invention relates to an apparatus for, and a method of, constructing a tunnel, gallery or the like hereinafter collectively referred to as a tunnel.

Various forms of apparatus are known for constructing tunnels underground. One form of apparatus, with which the invention is mainly concerned, employs a drive or cutting shield composed of elongate members or plates supported in side-by-side relationship around the tunnel so as to contact the wall thereof at least over the roof and side zones. These members are mounted on a rigid frame and are moved, usually by hydraulic rams, to attack a working face.

As the tunnel driving progresses the frame is moved up to follow the advanced members. In other constructions the drive shield is in the form of a continuous cylinder advanced by rams rather than separate members. Hitherto, various methods have been employed to support the tunnel wall behind the drive shield or its frame. One method which is often employed is to install pre-fabricated lining sections end-to-end as the driving progresses. Although this method is quite successful, the tunnel wall exposed by the shifting of the frame usually remains upsupported for some time until the appropriate lining sections can be placed in position. To overcome this problem other systems have been adopted which employ some form of temporary support for the exposed tunnel wall. However, this necessitates extra equipment and often involves a considerable extension in the overall length of the apparatus and this in turn creates additional problems particularly in that the overall progress of constructing the tunnel may be slowed down.

Examples of these known forms of apparatus are disclosed in U.S. Pat. Nos. 3,733,835 and 3,350,889 and in German Patent specification No. 1,534,670.

A general object of this invention is to provide an improved apparatus for and method of constructing a tunnel.

A further object of the invention is to provide an apparatus in which the tunnel lining installed behind the drive shield does not need to take up the forces involved in driving and which can thus proceed independently.

Another object of the invention is to provide an apparatus wherein the guidance and support of the members of the drive shield by the frame is supplemented by additional means.

A further objective is to provide apparatus which will enable the tunnel wall exposed behind the drive shield to be adequately sealed and supported as soon as it becomes accessible.

These objectives should be fulfilled as far as possible in an apparatus of moderate length which is relatively simple and economic.

BRIEF SUMMARY OF THE INVENTION

In one aspect the invention provides an apparatus for constructing a tunnel; said apparatus comprising a drive shield composed of a plurality of elongate members arranged side-by-side in parallel configuration and generally around the axis of the tunnel in contact with the tunnel wall, a frame for supporting and guiding the members for longitudinal displacement, means for causing relative displacement between the frame and the members in the direction of the axis of the tunnel whereby to effect driving of the tunnel and a movable rear shield disposed to support the tunnel wall rearwardly of the frame relative to the direction of tunnel driving, the members of the drive shield having rear end portions engaging on the rear shield at all times.

In another aspect the invention provides an apparatus for constructing a tunnel; said apparatus comprising a drive shield composed of a plurality of elongate members arranged side-by-side in parallel configuration and generally around the axis of the tunnel in contact with the tunnel wall, a frame for supporting and guiding the members for longitudinal displacement, means for causing relative displacement between the frame and the members in the direction of the tunnel axis whereby to effect driving of the tunnel, a movable rear shield for supporting the tunnel wall rearwardly of the frame relative to the direction of tunnel driving, the rear shield being movable to follow advancement of the drive shield, and means for rapidly sealing and supporting the tunnel wall exposed behind the rear shield as the latter is moved up to follow the drive shield.

The invention also provides a method of constructing an underground tunnel; said method comprising advancing each of a plurality of elongate members in relation to a support frame, the members being arranged side-by-side in parallel configuration around the axis of the tunnel to constitute a drive shield, shifting the frame forwardly up to the drive shield when the members have been advanced, shifting a rear shield disposed behind the frame relative to the direction of tunnel driving forwardly and utilizing a fluid concrete spraying device to seal and support the tunnel wall exposed as the rear shield is shifted up.

In general, the sealing and securing operation can be performed separately from and independently of the driving operation and does not slow down the driving progress. The driving forces can be absorbed by the drive shield and its frame without interfering with the rear tunnel components. The shifting of the rear shield can also be performed separately to the shifting of the frame so that, for example, the drive shield and frame may move through several shifting cycles before the rear shield is shifted.

The rear shield can be in the form of a ring of small axial thickness. The entire apparatus can thus be of comparatively small length thus reducing the possibility of partial slip or collapse of the tunnel wall. Moreover, the small length enables the apparatus to cope with any variation or curvature of the tunnel path.

The ring forming the rear shield can be directly connected to the frame to move therewith or else connected thereto through hydraulic rams enabling adjustment therebetween. Where the material being excavated is particularly difficult to seal e.g. loose soil, it may be desirable to have the ring sub-divided into arcuate sections each movable separately with respect to the frame.

The elongate members preferably engage on and are guided by the rear shield at all times. The members can have rear end portions which are disposed between the tunnel wall and the rear shield and the shield and the members may have some form of guide means, such as tongue-and-groove connections.

Preferably a platform is disposed in the frame and support means for detaching and conveying material from a working face at the front of the drive shield.

In order to seal and support the tunnel wall exposed behind the rear shield use can be made of a fluid concrete spraying device which can be rotatably mounted on the platform.

In accordance with the invention the tunnel wall surface exposed by the shifting of the rear shield can be more or less immediately sealed and supported with sprayed fluid concrete directly it becomes accessible and the entire surface may be progressively treated in this way to form a temporary or permanent lining. Where the ring is sub-divided into individual sections each movable separately, the lower parts or sections of the ring can be moved up to the frame first and concrete introduced over the exposed floor. This process can then be repeated whereby the tunnel wall is treated piece by piece. The drifting cutters and the follow-up ring completely support the tunnel wall from the moment when it has been worked until the moment when the securing means such as the sprayed concrete is introduced. The rock or soil is thus given no chance to loosen in the meantime.

The thrust forces transmitted to the individual member of the drive shield can be absorbed by the other members and their support frame so that the driving forces do not have to be imparted to the rear part of the apparatus or to the tunnel wall lining.

The apparatus thus provides the advantage that the driving or drifting process can be carried out independently of the operation of moving the follow-up ring up into position and thus independently of the concrete spraying operation.

Means is preferably provided to adjust the distance between the follow-up ring and the supporting frame so that the members or drifting cutters can be advanced with the support frame through a number of working cycles after which the follow-up ring can be moved up into position over the distance corresponding to these working cycles in one single operation and the exposed tunnel wall then sealed and secured.

The invention may be understood more readily, and various other features of the invention may become more apparent, from consideration of the following description.

BRIEF DESCRIPTION OF DRAWINGS.

An embodiment of the invention will now be described, by way of example only, with reference to the accompanying drawing, wherein.

DESCRIPTION OF PREFERRED EMBODIMENT

Figure 1:
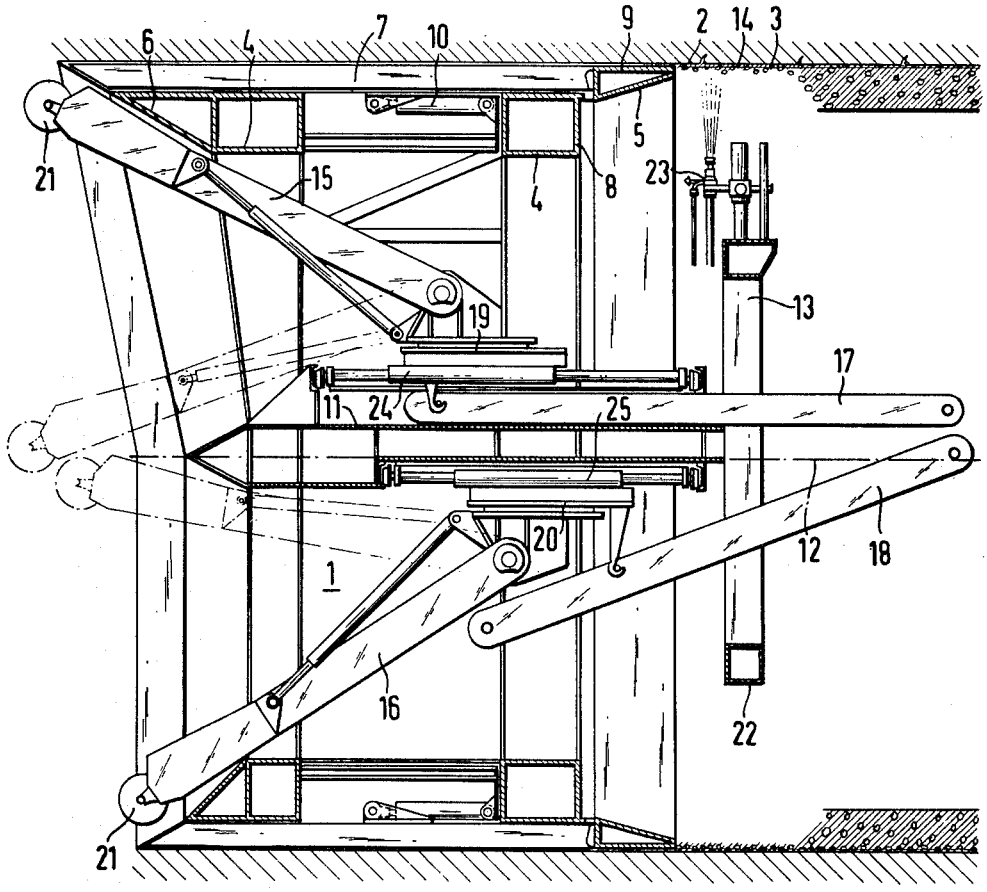
FIG. 1 is a schematic part-sectional side view of an apparatus made in accordance with the invention.

As shown in the drawings, the apparatus as illustrated, which is intended to produce an underground tunnel, gallery or similar excavation, employs a drive or cutting shield 6 composed in known manner of a series of generally elongate members 7. The apparatus is generally denoted by reference numeral 1. These elongate members 7, sometimes referred to as cutter planks, are arranged side-by-side in parallel configuration around the axis of the tunnel. For convenience, the individual members 7 have not been illustrated separately in the drawing. The members 7 preferably each have a curved arcuate cross-section so that overall the members 7 form a circular structure as shown or a domed structure constituting the shield 6, and defining the cross-sectional shape of the tunnel. Each member 7 has a cutting edge at its front end which is designed to penetrate a working face at the front end of the tunnel as the member 7 is thrust forwards. This working face would lie at the left-hand side of FIG. 1. Thus, the members 7 cut out a circular channel corresponding to the tunnel wall and the material within this channel can be detached and removed as described hereinafter. The members 7 are collectively supported and guided by means of a frame 4 which takes the form of two interconnected spaced-apart annular components as shown. In order to drive the members 7 forward into the working face there are provided double-acting hydraulic rams 10. Each ram 10 is connected between the frame 4 and one members 7 or a group of members 7. Thereby, extension of any one ram 10 will shift the member 7 or members 7 operably connected thereto parallel to the axis of the tunnel. During the driving of the tunnel, the rams 10 are extended one after another to advance the individual members or groups of members 7 and the frame 4 and the stationary members 7, which are in frictional contact with the tunnel wall, act as an abutment for the ram 10 which is extended. When all the rams 10 have been extended in this way, all the members 7, and hence the entire drive shield 6, are fully advanced and thereafter the rams 10 are operated in unison to retract and draw up the frame 4 towards the advanced shield. Here, all the members 7 collectively act as an effective abutment for the rams 10 by virtue of their frictional contact with the surrounding tunnel wall. At this stage, or prior to the shifting of the frame 4 the material at the working face within the members 7 can be detached and conveyed away ready for the next shifting sequence commencing with the successive advancement of the members 7. In the position as represented in FIG. 1, the shield 6 has not been advanced and all the rams 10 are in a retracted state.

A further support means in the form of an additional shield or ring 5 is disposed rearwardly of the frame 4 relative to the direction of tunnel advancement. The members 7 have rear portions 9 which at least contact the exterior of the ring 5 and are guided thereby. Preferably these portions 9 locate within guide slots in the ring 5. The arrangement may be such that when any member 7 is fully advanced into the working face by its associated ram 10 the rear portion 9 thereof still engages on the exterior of the ring 5 but is of course displaced towards the working face relative to the rings 5, i.e. towards the left-hand side of FIG. 1. The ring 5 is normally intended to move with the frame 4 and some appropriate connection means (not shown) is thus provided between the frame 4 and the ring 5. It is, however, preferable to utilize further hydraulic rams (not shown) to interconnect the rear end 8 of the frame 4 and the ring 5.

These further rams can then be used to adjust the distance between the frame 4 and the ring 5 for example to enable the shield 6 to perform several advancing cycles each involving the shifting of the members 7 and then the frame 4, before the ring 5 is actually drawn up. The stroke of these further rams would be made somewhat greater and preferably some multiple of the stroke of the rams 10.

Figure 2:
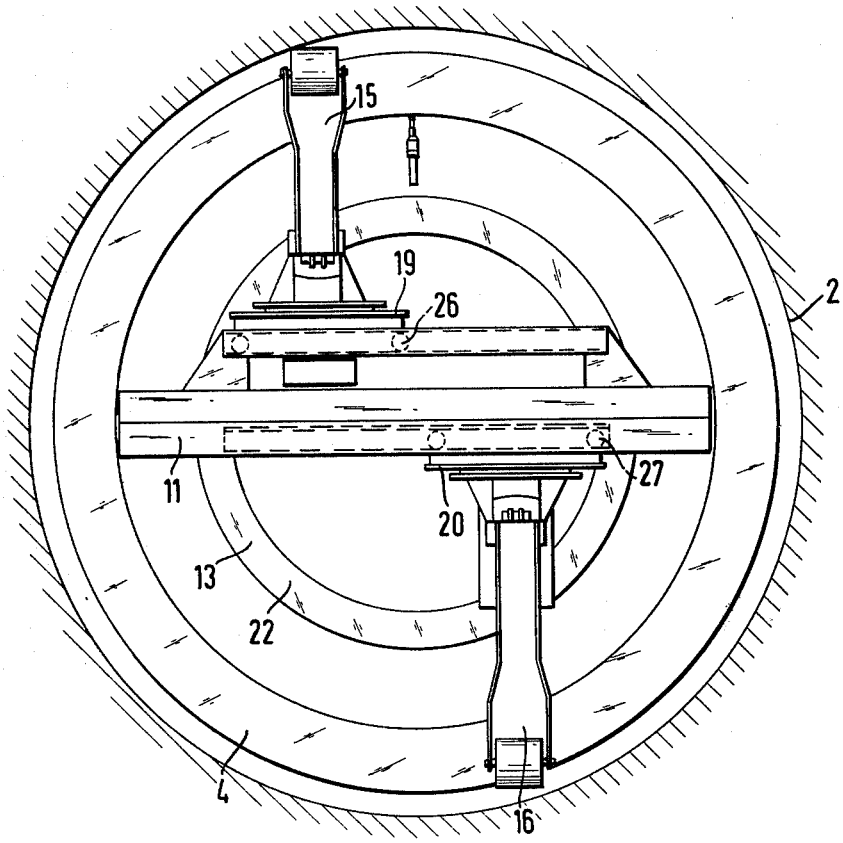
FIG. 2 is a front end view of the apparatus shown in FIG. 1.

A horizontal working platform 11 is located within the shield 6 at about the level of the longitudinal central axis 12 of the apparatus 1 which is nominally the axis of the tunnel itself. The platform 11 is rigidly secured to the frame 4 and serves to support a pair of complementary devices 15, 16 for transferring debris material away from the working face. The devices 15, 16 are respectively located above and beneath the platform 11. Each device 15, 16 has a boom or jib pivotably supported at its rear end for swinging up and down in a vertical sense. Means, such as piston and cylinder units as shown, are provided to enable the booms to swing in this manner. The booms have cutting and/or loading appliances generally designated 21 at their free ends. These appliances which can be raised or lowered with the booms can take the form of bladed drums or rollers or the like, engageable with the working face. The pivotably-mounted rear end of the boom of each device 15, 16 is supported on a pillar projecting from a rotatable turntable 19, 20. The piston and cylinder units for swinging the boom up and down are connected to these turntables 19, 20. Means, which may again be in the form of piston and cylinder units, are provided for partly rotating the turntables 19, 20 to enable the booms to swing around horizontal arcuate paths. The turntables 19, 20 are themselves supported for transverse movement across the tunnel on a wheeled sub-frame 26, 27 guided by tracks on the platform 11. Means, such as piston and cylinder units, are provided to displace the frames 26, 27 and hence the turntables 19, 20 and booms across the platform 11. FIG. 2 shows the position where the devices 15, 16 are located at opposite sides of the platform 11. Each device 15, 16 can be moved from the position depicted in FIG. 2 to the opposite position. The platforms 19, 20 are carried by the cylinders of double-acting hydraulic rams 24, 25 used for displacing the entire devices 15, 16 towards or away from the working face and parallel to the axis 12. The piston rods of the rams 24, 25 may form part of the wheeled sub-frames 26, 27 permitting the entire structure 15, 19, 24 or 16, 20, 25 to move transversely.

The boom of each device 15, 16 supports or incorporates a conveyor which is used to transport debris material along the boom and away from the appliance 21. The device 15 serves to detach and transport debris material which is discharged into a further separate conveyor 17 supported on the platform 11. The conveyor 17 is connected to the cylinder of the ram 24 by means of one or more claw-type fastenings. Similarly, the device 16 serves to detach and transport debris material which is discharged into a further separate conveyor 18 carried by the platform 11 and connected with the turntable 20 by means of one or more claw-type fastenings. The upper conveyor 17 takes takes a substantially horizontal course whereas the conveyor 18 is inclined upwardly from the device 16 and is suspended by the claw-fastening(s). The material discharged from the rear ends of the conveyors 17, 28 can be collected in containers or by another conveyor and transported away from the front end of the tunnel.

In a modified construction, the dual devices 15, 16 and conveyors 17, 18 can be replaced by a single device and conveyor.

The rear end part of the platform 11 supports a device 13 used to spray fluid concrete 14 onto the exposed wall 2 of the tunnel immediately behind the ring 5 to form a temporary or permanent lining 3 for sealing and supporting the tunnel wall. This device 13 takes the form of a gun or nozzle 33 which is supported for rotation about a ring 22 secured to the platform 11 in a position coaxial with the axis 12 of the apparatus 1. The creation of a small gap between the untreated tunnel wall 2 and at least part of the exterior of the ring 5 as the members 7 are moved up and corresponding to the radial or width dimension of the portions 9 thereof is usually quite tolerable and does not involve any significant loosening or slip of the tunnel wall surface. The formation of the concrete lining 3 can be synchronized with the actual tunnel driving operation as described so that the forward end of the tunnel is continuously supported by the shield and wall 2, exposed when the ring 5 is moved up, is treated more or less immediately with the sprayed concrete 14 to effect sealing and support, either temporary or permanent. Nevertheless the driving process and the spraying process are separate and independent of one another.

Where the material being excavated is particularly troublesome, e.g. loose soil, it is advantageous to replace the unitary-structure ring 5 with a multi-part ring 5 composed of a series of arcuate sections each individually adjustable, for example with a ram, in relation to the rear end of the frame 4. This then enables the ring 5 to be drawn up in stages section by section so that the exposed wall 2 can be sprayed over in smaller sections rather than over a continuous zone. Thus, for example, the lower section(s) of the ring 5 can be advanced first towards the frame 4 and the lining 3 can be built up over the floor region and then progressively over the roof region as each section of the ring 5 is shifted.

We claim:

1. An apparatus for constructing a tunnel; said apparatus comprising a drive shield composed of a plurality of elongate cutter plank members arranged side-by-side in parallel configuration and forming a cylindrical array extending generally around the axis of the tunnel in contact with the tunnel wall, a frame for supporting and guiding the cutter plank members for longitudinal displacement, means for causing relative displacement between the frame and the members in the direction of the axis of the tunnel to effect driving of the tunnel a movable rear shield positioned rearwardly of said frame to support the tunnel wall rearwardly of the frame relative to the direction of tunnel driving and at a distance with respect to said frame, with sealing of said tunnel wall occurring behind the rear shield and wherein said cutter plank members of the drive shield have rear end portions peripherally overlying the rear shield such that regardless of the position of the movable rear shield with respect to the frame and the position of the longitudinally displaceable cutter plank members relative to said rear shield, the rear end portions of the drive shield peripherally overlie the rear shield at all times during operation of the apparatus.

2. An apparatus for constructing a tunnel; said apparatus comprising a drive shield composed of a plurality of elongate cutter plank members arranged side-by-side in parallel configuration and forming a cylindrical array extending generally around the axis of the tunnel in contact with the tunnel wall, a frame for supporting and guiding the cutter plank members for longitudinal displacement, means for causing relative displacement between the frame and the cutter plank members in the direction of the axis of the tunnel to effect driving of the tunnel, a movable rear shield positioned rearwardly of said frame and separate therefrom to support the tunnel wall rearwardly of the frame relative to the direction of tunnel driving, and movable relative to said frame for following advancement of the drive shield, said members of the drive shield having rear end portions which peripherally overlie, are in contact with and are guided by the rear shield regardless of the position of the rear shield relative to said frame and said cutter plank members of said drive shield.

3. In an apparatus for constructing a tunnel; said apparatus comprising a drive shield composed of a plurality of elongate members arranged side-by-side and generally around the axis of the tunnel in contact with the tunnel wall, a frame for supporting and guiding the members for longitudinal displacement and means for causing relative displacement between the frame and the members in the direction of the tunnel axis to effect driving of the tunnel; the improvement comprising:

a rear support structure disposed rearwardly of the frame and separate therefrom relative to the direction of tunnel driving;

said rear support structure having a larger cross-section than the frame so as to have an external surface nearer the tunnel wall than the frame, the support structure being movable with the frame to follow advancement of the drive shield, elongate members of the shield having rear end portions which are reduced in thickness transversely of the tunnel axis relative to the remainder of the members with the rear end portions of the members engaging on and being guided by the support structure at all times.

4. An apparatus according to claim 3, further comprising means for sealing and supporting the tunnel wall immediately behind said rear support structure as said rear support is moved to follow the drive shield.

5. An apparatus according to claim 4, wherein the means for sealing and supporting the tunnel wall comprises a device for spraying fluid concrete and wherein there is further provided a platform mounted within the frame and serving to support means for detaching and conveying debris material away from a working face at the front of the drive shield, the spraying device being supported by a rear end part of the platform.

6. An apparatus according to claim 4, wherein the means for sealing and supporting the tunnel wall comprises a device for spraying fluid concrete onto said wall.

7. An apparatus according to claim 6, wherein the spraying device has a nozzle for emitting the fluid concrete which is rotatable about the axis of the tunnel to spray the concrete onto the tunnel wall immediately behind the rear shield as the latter is shifted up.

8. An apparatus according to claim 3, and further comprising a platform mounted within the frame and serving to support means for detaching and conveying debris material away from a working face at the front of the drive shield.

9. An apparatus according to claim 8, wherein the means for detaching and conveying material comprises at least one conveyor co-operating with at least one boom supported by a rotatable turntable which is also displaceable both laterally and longitudinally of the tunnel, the boom being raisable and lowerable and having detaching means at its free end engageable with the working face.

10. An apparatus according to claim 8, wherein the platform is horizontal or substantially horizontal and is supported by the frame in an elevated position in the vicinity of the longitudinal axis of the tunnel.

11. In a tunnel driving apparatus which comprises a plurality of elongate drive members arranged side-by-side in parallel configuration and generally around the axis of the tunnel in supporting contact with the tunnel wall, a frame for supporting and guiding the drive members for longitudinal displacement and means for causing relative displacement between the frame and the members in the direction of advancement of the tunnel; the improvement comprising: a support structure disposed rearwardly of the frame relative to the direction of advancement of the tunnel, the support structure being movable with the frame to follow advancement thereof and facilitate sealing of said tunnel wall immediately behind said support structure and having an external support surface disposed radially outwardly from the tunnel axis relative to the frame so as to lie closely adjacent the tunnel wall and narrow tongue-like rear portions on the drive members which engage in an annular gap between the tunnel wall and the external support surface of the support structure so as to be guided by said surface, the rear portion and the remainder of each drive member having a continuous exterior surface engaging on the tunnel wall and the rear portion defining a recess on the opposite side to the exterior surface which receives the rear structure.

12. A method of constructing an underground tunnel; said method comprising:

advancing each of a plurality of elongate members in relation to a support frame, the members being arranged side-by-side in parallel configuration around the axis of the tunnel in contact with the tunnel wall, shifting the frame forward when the members have been advanced, utilizing a rear support structure which is movable with the frame and which has a large cross-section than the frame to support and guide reduced rear end portions of the elongate members, and spraying with a fluid concrete spraying device immediately behind said rear support to seal and support the tunnel wall as the support structure is shifted forwardly.

13. A method according to claim 12, wherein the rear shield is shifted with the frame.

14. A method according to claim 12, wherein the rear support structure is shifted independently of the shifting of the frame.

* * * * *